US009080431B2

(12) United States Patent
Bell et al.

(10) Patent No.: US 9,080,431 B2
(45) Date of Patent: Jul. 14, 2015

(54) METHOD FOR PERFORATING A WELLBORE IN LOW UNDERBALANCE SYSTEMS

(75) Inventors: Matthew Robert George Bell, Dallas, TX (US); David S. Wesson, Dallas, TX (US); Nathan Garret Clark, Mansfield, TX (US); John Thomas Hardesty, Dallas, TX (US)

(73) Assignee: GEODYNAMICS, INC., Millsap, TX (US)

( * ) Notice: Subject to any disclaimer, the term of this patent is extended or adjusted under 35 U.S.C. 154(b) by 455 days.

(21) Appl. No.: 12/627,897

(22) Filed: Nov. 30, 2009

(65) Prior Publication Data

US 2010/0132945 A1 Jun. 3, 2010

Related U.S. Application Data

(60) Provisional application No. 61/118,995, filed on Dec. 1, 2008.

(51) Int. Cl.
*E21B 43/117* (2006.01)
*E21B 21/00* (2006.01)

(52) U.S. Cl.
CPC ..... *E21B 43/117* (2013.01); *E21B 2021/006* (2013.01)

(58) Field of Classification Search
CPC ..... E21B 43/117; E21B 2021/006
USPC ..... 166/297, 299, 55; 175/4.5, 4.6
See application file for complete search history.

(56) References Cited

U.S. PATENT DOCUMENTS

| | | | | |
|---|---|---|---|---|
| 3,188,955 | A * | 6/1965 | Brown | 102/306 |
| 3,983,941 | A | 10/1976 | Fitch | |
| 4,078,612 | A * | 3/1978 | Gallus | 166/299 |
| 4,107,057 | A | 8/1978 | Dill et al. | |
| 4,220,205 | A | 9/1980 | Coursen et al. | |
| 4,372,384 | A | 2/1983 | Kinney | |
| 5,318,128 | A | 6/1994 | Johnson et al. | |
| 6,598,682 | B2 * | 7/2003 | Johnson et al. | 166/370 |
| 6,962,203 | B2 | 11/2005 | Funchess | |
| 7,165,614 | B1 * | 1/2007 | Bond | 166/297 |
| 7,273,099 | B2 * | 9/2007 | East et al. | 166/280.1 |
| 7,393,423 | B2 | 7/2008 | Liu | |
| 7,712,416 | B2 | 5/2010 | Pratt et al. | |
| 2003/0037692 | A1 | 2/2003 | Liu | |
| 2003/0089498 | A1 | 5/2003 | Johnson et al. | |
| 2004/0089449 | A1 | 5/2004 | Walton et al. | |
| 2005/0056459 | A1 * | 3/2005 | Haney et al. | 175/4.6 |
| 2005/0115448 | A1 | 6/2005 | Pratt et al. | |

(Continued)

OTHER PUBLICATIONS

GEODynamics Engineered Perforating Solutions, 2009 GEODynamics Inc., Client Spotlight, Jul. 2009.

(Continued)

*Primary Examiner* — Robert E Fuller
(74) *Attorney, Agent, or Firm* — David W. Carstens; Shaukat A. Karjeker; Carstens & Cahoon, LLP

(57) ABSTRACT

By substantially eliminating the crushed zone surrounding a perforation tunnel and expelling debris created upon activation of a shaped charge with first and second successive explosive events, the need for surge flow associated with underbalanced perforating techniques is eliminated. The break down of the rock fabric at the tunnel tip, caused by the near-instantaneous overpressure generated within the tunnel, further creates substantially debris-free tunnels in conditions of limited or no underbalance as well as in conditions of overbalance.

11 Claims, 5 Drawing Sheets

(56) References Cited

U.S. PATENT DOCUMENTS

| | | | | |
|---|---|---|---|---|
| 2006/0266551 | A1* | 11/2006 | Yang et al. | 175/4.6 |
| 2007/0056462 | A1 | 3/2007 | Bates et al. | |
| 2008/0230225 | A1 | 9/2008 | Meddes et al. | |
| 2008/0271894 | A1 | 11/2008 | Hill et al. | |
| 2010/0132945 | A1 | 6/2010 | Bell et al. | |
| 2010/0132946 | A1 | 6/2010 | Bell et al. | |

OTHER PUBLICATIONS

GEODynamics Engineered Perforating Solutions, Oct. 2008 GEODynamics, Inc., CONNEX Perforating, ReActive Perforating Technology.

Bell, Hardesty, and Clark, "Reactive Perforating: Conventional and Unconventional Applications, Learnings, and Opportunities," SPE 122174, 2009 Society of Petroleum Engineers, May 27, 2009.

Bell and Cuthill, "Next-Generation Perforating System Enhances the Testing and Treatment of Fracture Stimulated Wells in Canada," SPE 116226, 2008, Society of Petroleum Engineers, Sep. 21, 2008.

Denney, "Technology Applications," JPT Online, Jul. 2007, located at http://www.spe.org/spe-app/spe/jpt/2007/07/TechApps.htm, downloaded Nov. 28, 2009.

Yang, et al. "Flow Performance of Perforation Tunnels Created With Shaped Charges Using Reactive Liner Technology", SPE 121931, SPE International, Society of Petroleum Engineers, 2009, pp. 1-17.

* cited by examiner

METHOD FOR PERFORATING A WELLBORE IN LOW UNDERBALANCE SYSTEMS

CROSS-REFERENCE TO RELATED APPLICATION

This application claims priority to provisional application Ser. No. 61/118,995, filed Dec. 1, 2008.

TECHNICAL FIELD

The present invention relates generally to reactive shaped charges used in the oil and gas industry to explosively perforate well casing and underground hydrocarbon bearing formations, and more particularly to an improved method for explosively perforating a well casing and its surrounding underground hydrocarbon bearing formation under balanced or near-balanced pressure conditions.

BACKGROUND OF THE INVENTION

Wellbores are typically completed with a cemented casing across the formation of interest to assure borehole integrity and allow selective injection into and/or production of fluids from specific intervals within the formation. It is necessary to perforate this casing across the interval(s) of interest to permit the ingress or egress of fluids. Several methods are applied to perforate the casing, including mechanical cutting, hydrojetting, bullet guns and shaped charges. The preferred solution in most cases is shaped charge perforation because a large number of holes can be created simultaneously, at relatively low cost. Furthermore, the depth of penetration into the formation is sufficient to bypass near-wellbore permeability reduction caused by the invasion of incompatible fluids during drilling and completion.

FIG. 1 illustrates a perforating gun 10 consisting of a cylindrical charge carrier 14 with explosive charges 16 (also known as perforators) lowered into the well by means of a cable, wireline, coil tubing or assembly of jointed pipes 20. Any technique known in the art may be used to deploy the carrier 14 into the well casing. At the well site, the explosive charges 16 are placed into the charge carrier 14, and the charge carrier 14 is then lowered into the oil and gas well casing to the depth of a hydrocarbon bearing formation 12. The explosive charges 16 fire outward from the charge carrier 14 and puncture holes in the wall of the casing and the hydrocarbon bearing formation 12. As the charge jet penetrates the rock formation 12 it decelerates until eventually the jet tip velocity falls below the critical velocity required for it to continue penetrating. As best depicted in FIG. 2A, the tunnels created in the rock formation 12 are relatively narrow. Particulate debris 22 created during perforation leads to plugged tunnel tips 18 that obstruct the production of oil and gas from the well.

Perforation using shaped explosive charges is inevitably a violent event, resulting in plastic deformation 28 of the penetrated rock, grain fracturing, and the compaction 26 of particulate debris (casing material, cement, rock fragments, shaped charge fragments) into the pore throats of rock surrounding the tunnel (as best shown in FIG. 2B). Thus, while perforating guns do enable fluid production from hydrocarbon bearing formations, the effectiveness of traditional perforating guns is limited by the fact that the firing of a perforating gun leaves debris 22 inside the perforation tunnel and the wall of the tunnel. Moreover, the compaction of particulate debris into the surrounding pore throats results in a zone

26 of reduced permeability (disturbed rock) around the perforation tunnel commonly known as the "crushed zone." The crushed zone 26, though only typically about one quarter inch thick around the tunnel, detrimentally affects the inflow and/or outflow potential of the tunnel (commonly known as a "skin" effect.) Plastic deformation 28 of the rock also results in a semi-permanent zone of increased stress around the tunnel, known as a "stress cage", which further impairs fracture initiation from the tunnel. The compacted mass of debris left at the tip 18 of the tunnel is typically very hard and almost impermeable, reducing the inflow and/or outflow potential of the tunnel and the effective tunnel depth (also known as clear tunnel depth).

The geometry of a tunnel will also determine its effectiveness. The distance the tunnel extends into the surrounding formation, commonly referred to as total penetration, is a function of the explosive weight of the shaped charge; the size, weight, and grade of the casing; the prevailing formation strength; and the effective stress acting on the formation at the time of perforating. Effective penetration is some fraction of the total penetration that contributes to the inflow or outflow of fluids. This is determined by the amount of compacted debris left in the tunnel after the perforating event is completed. The effective penetration may vary significantly from perforation to perforation. Currently, there is no means of measuring it in the borehole. Darcy's law relates fluid flow through a porous medium to permeability and other variables, and is represented by the equation seen below:

$$q = \frac{2\pi kh(p_e - p_w)}{\mu\left[\ln\left(\frac{r_e}{r_w}\right) + S\right]}$$

Where: q=flowrate, k=permeability, h=reservoir height, $P_e$=pressure at the reservoir boundary, $p_w$=pressure at the wellbore, μ=fluid viscosity, $r_e$=radius of the reservoir boundary, $r_w$=radius of the wellbore, and S=skin factor.

The effective penetration determines the effective wellbore radius, $r_w$, an important term in the Darcy equation for radial inflow. This becomes even more significant when near-wellbore formation damage has occurred during the drilling and completion process, for example, resulting from mud filtrate invasion. If the effective penetration is less than the depth of the invasion, fluid flow can be seriously impaired.

Inadequately cleaned tunnels limit the area through which produced or injected fluids can flow, causing increased pressure drop and erosion; increase the risk that fines migrate towards the limited inflow point and/or condensate banking (in the case of gas) occurs around the inflow point, resulting in significant loss of productivity; and impair fracture initiation and propagation.

Currently, common procedures to clear debris from tunnels rely on flow induced by a relatively large pressure differential between the formation and the wellbore. Perforating underbalanced involves creating the opening through the casing under conditions in which the hydrostatic pressure inside the casing is less than the reservoir pressure. Underbalanced perforating has the tendency to allow the reservoir fluid to flow into the wellbore. Conversely, perforating overbalanced involves creating the opening through the casing under conditions in which the hydrostatic pressure inside the casing is greater than the reservoir pressure. Overbalanced perforating has the tendency to allow the wellbore fluid to flow into the reservoir formation. It is generally preferable to perform underbalanced perforating as the influx of reservoir fluid into the wellbore tends to clean up the perforation tunnels and increase the depth of the clear tunnel of the perforation.

Underbalancing techniques maintain a pressure gradient from the formation toward the wellbore, inducing tensile failure of the damaged rock around the tunnel and a surge of flow to transport debris from the perforation tunnel into the wellbore. In other words, in conventional underbalance perforating, the wellbore pressure is kept below reservoir pressure before firing or detonating a perforation gun to create a static underbalance. FIG. 3 depicts the cleaning surge flow in an underbalanced system after explosive charges 16 are fired. After perforation, fluid flows from the formation through the tunnels. As the fluid flows through the tunnels and egresses through the tunnel openings 24, it takes with it the debris 22 formed as a result of perforation. Little, if any, debris 22 remains in the tunnels if a sufficient surge flow can be induced. However, underbalance perforating may not always be effective and/or may at times be expensive or unsafe to implement. Although underbalanced perforating techniques are relatively successful in homogenous formations of moderate to high natural permeability, in a number of situations, it is undesirable, difficult or even impossible to create a sufficient pressure gradient between the formation and the wellbore. For example, when the reservoir is shallow or depleted, the hydrostatic pressure of even a very light fluid or gas within the wellbore will result in only a very minimal underbalance being generated, which may be too low to induce a flow rate sufficient to clean the tunnel. Further, when working with a wellbore having open perforation tunnels, fluids will flow from the existing perforations as soon as a pressure difference is created, limiting the amount of underbalance that can be applied without adversely affecting tools in the wellbore or surface equipment. If perforation is performed without underbalance using conventional shaped charges, the fraction of unobstructed tunnels as a percentage of total holes perforated (also known as "perforation efficiency") may be 10% or less.

Consequently, there is a need for an improved method of perforating a cased wellbore in situations where underbalancing techniques are undesired or unavailable. There is also a need for achieving superior inflow and/or outflow performance compared to that achieved with conventional shaped charges under the same perforating conditions.

SUMMARY OF THE INVENTION

It has been found that by activating a perforating gun having reactive shaped charges which produce a second, local reaction following the creation of perforation tunnels, superior inflow and/or outflow performance is delivered compared to that achieved with conventional shaped charges, without establishing a pressure differential. Even when perforating at balanced or near-balanced pressure conditions, reactive shaped charges deliver unobstructed tunnels with unimpaired tunnel walls, which results in improved inflow and/or outflow potential and improved inflow and outflow distribution of produced or injected fluids across the perforated interval.

A number of activities or situations that prevent the establishment of a pressure differential between the formation of interest and the wellbore, including without limitation the following activities, would therefore benefit from the present invention. First, perforation of wellbores using a conveyance method incompatible with significant pressure underbalance, such as slickline or electric line conveyed perforating with or without tractor assistance would benefit from the present invention in that no underbalance is required. Second, perforation of wellbores using surface equipment incapable of significantly reducing the hydrostatic pressure in the wellbore, such as in the absence of fluid pumping or circulating equipment and/or gas generating (e.g. nitrogen) equipment would also benefit from the present invention for the same reasons. Third, perforation of wellbores already having existing open perforations from which fluids will influx into the wellbore in an underbalanced condition would benefit in that the amount of underbalance that can be applied in these situations is limited. Underbalancing techniques that cause fluid influx will likely either cause the perforating tools to move undesirably up the wellbore or reach the maximum flow potential of the well or surface equipment connected thereto for receiving produced fluids. Fourth, perforation of intervals having very low reservoir pressure that will result in a near-balanced, balanced or over-balanced condition even with a very light fluid or gas in the wellbore, either as a result of low initial reservoir pressure or of depletion due to production, will benefit from the present invention because no underbalance is required to clean the tunnels of debris. Finally, the present invention is beneficial for perforation of intervals where the formation rock is prone to failure under drawdown and where the undesirable ingress of formation material into the wellbore might occur if perforation takes place in a significantly underbalanced condition.

These and other objectives and advantages of the present invention will be evident to experts in the field from the detailed description of the invention illustrated as follows.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
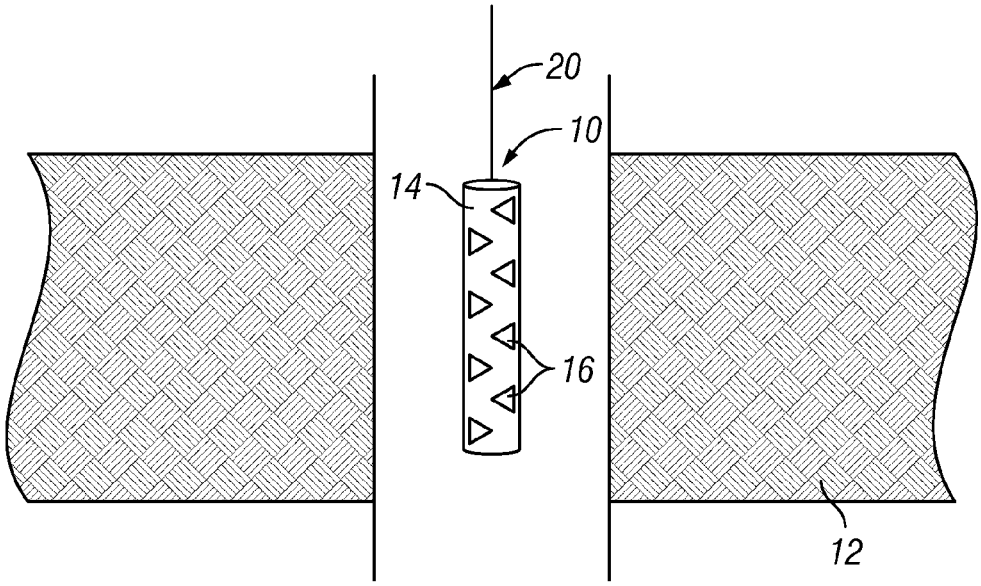
FIG. 1 (Prior Art)
FIG. 1 is a cross-sectional view of a prior art perforating gun inside a well casing.
Figure 2A:
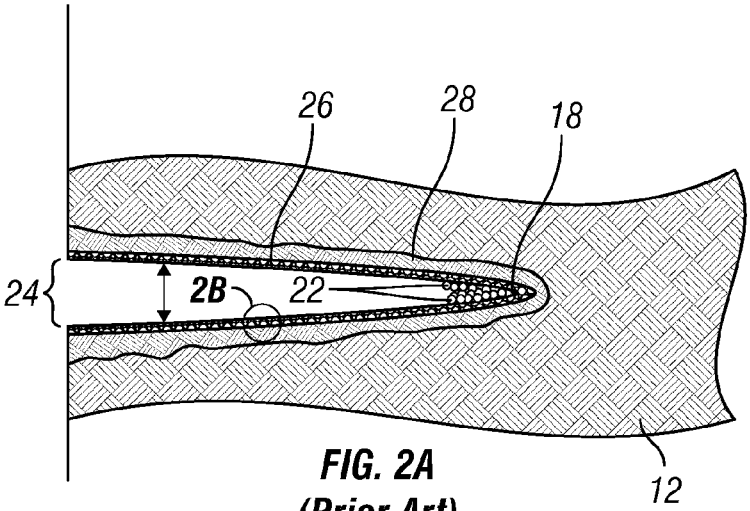
FIG. 2A (Prior Art)
FIG. 2A is a cross-sectional view of a perforation tunnel created as a result of prior art methods.
Figure 2B:
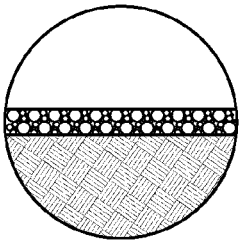
FIG. 2B is a close up detailed view of the compacted fill experienced within a perforation tunnel as shown in FIG. 2A.
Figure 3:
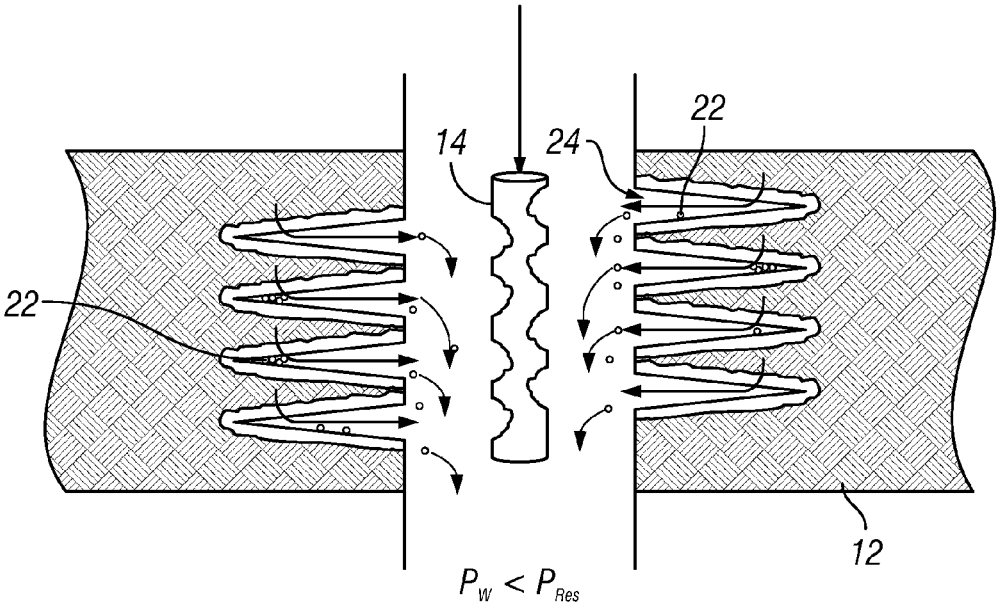
FIG. 3 (Prior Art)
FIG. 3 is a cross-sectional view of a conventional perforation device utilizing prior art underbalance methods to clean a perforation tunnel.

Where used in the various Figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE PREFERRED EMBODIMENTS

The method of the present application provides an improved method for the perforation of a wellbore, which eliminates the crushed zone and fractures the end (referred to also as one or more tip fractures) of a perforation tunnel, resulting in improved perforation efficiency and effective tunnel cleanout, without having to perforate in an underbalanced pressure condition. In other words, without having to control or reduce the pressure within a wellbore, as commonly necessary in currently known methods, as discussed above.

Figure 4:
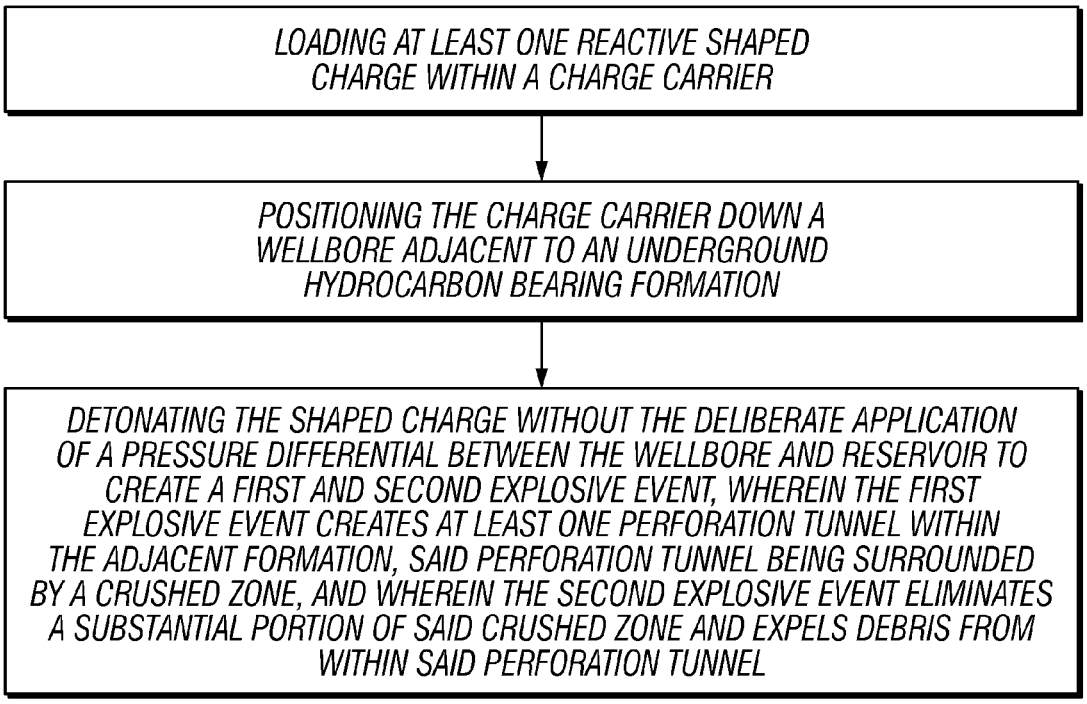
FIG. 4 depicts a flow chart of the present method.

FIG. 4 depicts a flowchart of the improved method of the present invention for perforating a well in a balanced, overbalanced or low underbalanced condition. The present invention comprises the steps of loading at least one reactive shaped charge within a charge carrier; positioning the charge carrier adjacent to an underground hydrocarbon bearing formation; detonating the charge carrier without the deliberate application of a pressure differential between the wellbore and reservoir to create a first and second explosive event, wherein the first explosive event creates at least one perforation tunnel within the adjacent formation, said perforation tunnel being surrounded by a crushed zone, and wherein the second explosive event eliminates a substantial portion of said crushed zone and expels debris from within said perforation tunnel.

The second explosive event is a local reaction that takes place only within said perforation tunnel to eliminate a substantial portion of the crushed zone created during the perforation and fractures the tip of each of said perforation tunnel. Moreover, the secondary reaction results in the creation of a clean tunnel depth equal to the total depth of the penetration of the jet.

In one embodiment, the crushed zone is eliminated by exploiting chemical reactions. By way of example, and without limitation, the chemical reaction between a molten metal and an oxygen-carrier such as water is produced to create an exothermic reaction within and around a perforation tunnel after detonation of a perforating gun. In another embodiment, the crushed zone is eliminated and one or more tip fractures are created by a strong exothermic intermetallic reaction between liner components within and around perforation tunnel.

As used herein, the phrase "deliberate application of a pressure differential" refers to deliberate adjustment of the pressure in the wellbore as compared to that of the reservoir; in particular, the method applies to balanced or near balanced pressure conditions where the pressure inside the wellbore at the depth of the reservoir is substantially equal to or somewhat greater than the pressure in the reservoir at that same depth. The term "pressure differential" is meant to apply to difference between the pressures within the wellbore and within the reservoir, independent of any other reaction or perforation, and independent of any pressure change caused by or during any reaction or perforation. Further, as used herein, a fracture is a local crack or separation of a hydrocarbon bearing formation into two or more pieces.

In one embodiment, the elimination of a substantial portion of the crushed zone is created by inducing one or more strong exothermic reactive effects to generate near-instantaneous overpressure within and around the tunnel. Preferably, the reactive effects are produced by shaped charges having a liner manufactured partly or entirely from materials that will react inside the perforation tunnel, either in isolation, with each other, or with components of the formation. In a first embodiment, the shaped charges comprise a liner that contains a metal, which is propelled by a high explosive, projecting the metal in its molten state into the perforation created by the shaped charge jet. The molten metal is then forced to react with water that also enters the perforation, creating a reaction locally within the perforation. In a second and preferred embodiment, the shaped charges comprise a liner having a controlled amount of bimetallic composition which undergoes an exothermic intermetallic reaction. In another preferred embodiment, the liner is comprised of one or more metals that produce an exothermic reaction after detonation.

Reactive shaped charges, suitable for the present invention, are disclosed in U.S. Pat. No. 7,393,423 to Liu and U.S. Patent Application Publication No. 2007/0056462 to Bates et al., the technical disclosures of which are both hereby incorporated herein by reference. Liu discloses shaped charges having a liner that contains aluminum, propelled by a high explosive such as RDX or its mixture with aluminum powder. Another shaped charge disclosed by Liu comprises a liner of energetic material such as a mixture of aluminum powder and a metal oxide. Thus, the detonation of high explosives or the combustion of the fuel-oxidizer mixture creates a first explosion, which propels aluminum in its molten state into the perforation to induce a secondary aluminum-water reaction. Bates et al. discloses a reactive shaped charge made of a reactive liner made of at least one metal and one non-metal, or at least two metals which form an intermetallic reaction. Typically, the non-metal is a metal oxide or any non-metal from Group III or Group IV, while the metal is selected from Al, Ce, Li, Mg, Mo, Ni, Nb, Pb, Pd, Ta, Ti, Zn, or Zr. After detonation, the components of the metallic liner react to produce a large amount of energy.

In general, however, any charge that contains any oxidizing and combustible units, or other ingredients in such proportions, quantities, or packing that ignition by fire, heat, electrical sparks, friction, percussion, concussion, or by detonation of the compound, mixture, or device or any part thereof is suitable for use with the present invention so long as it causes a first and second explosive event following detonation, with production of a perforation tunnel. The second explosive event is preferably localized or substantially contained within a corresponding perforation tunnel. Suitable causes for the second explosive event include, without limitation, reactions or interactions between one or more powders used for blasting, any chemical compounds, mixtures and/or other detonating agents, whether with one another or with another element or substance present or introduced into the formation.

Figure 5A:
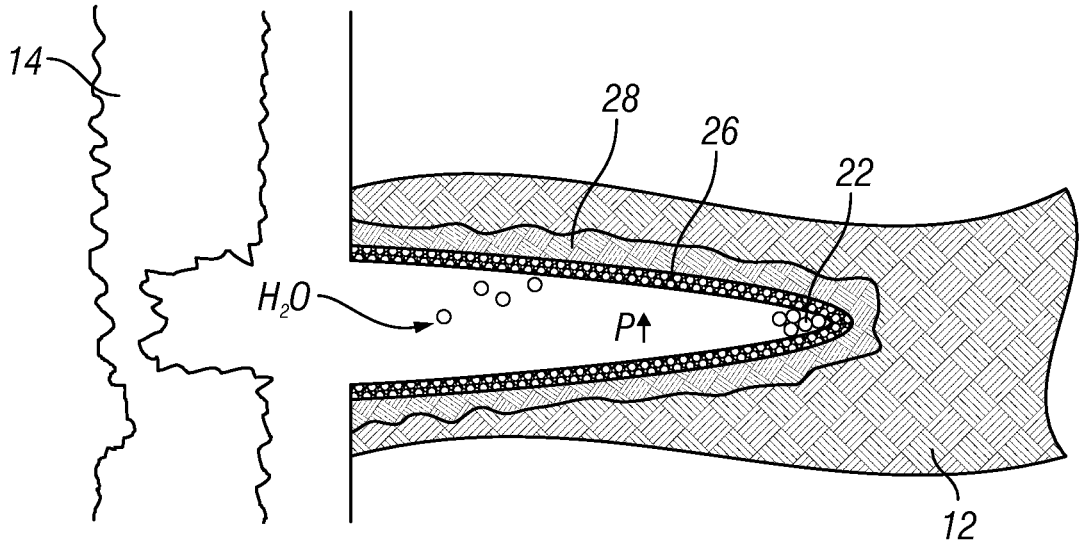
FIG. 5*a* is a cross-sectional close up view of a perforation tunnel created after a reactive charge is blasted into a hydrocarbon bearing formation.
Figure 5B:
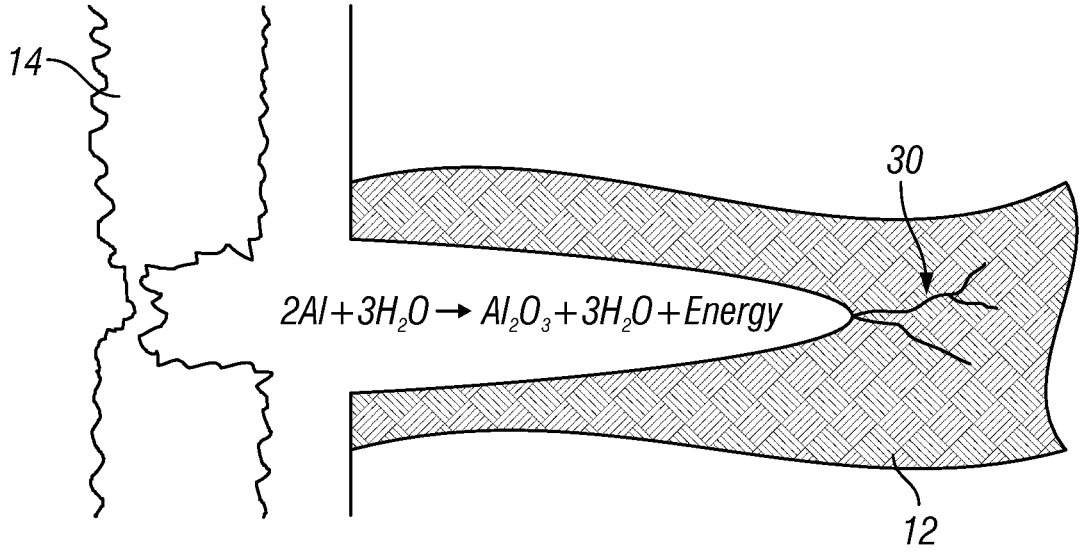
FIG. 5*b* is a cross-sectional close up view of the perforation tunnel of FIG. 5*a* after the secondary explosive reaction has occurred.
Figure 6:
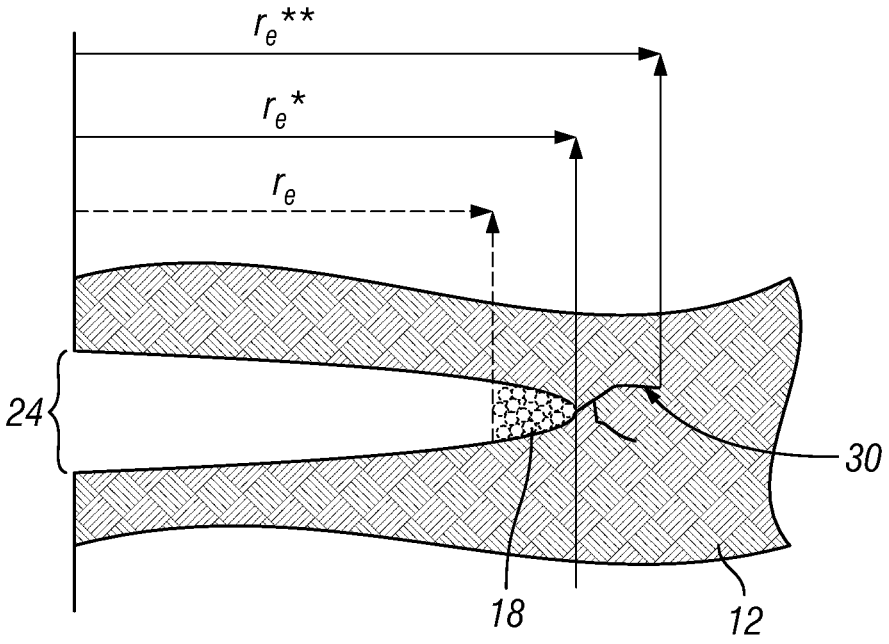
FIG. 6 is a cross-sectional close up view of the wider effective wellbore radii and cleaner perforation tunnel experienced with the method of the present invention, as compared to the prior art methods using underbalancing techniques.

Without being bounded by theory, FIGS. 5*a*-5*b* depict the theoretical process that occurs within the hydrocarbon-bearing formation 12 as a reactive charge comprising an aluminum liner is activated. As shown in FIG. 5*a*, the activated charge carrier 14 has fired the reactive charge into the formation 12 and has formed a tunnel surrounded by the crushed zone 26, described above. Because the liner is comprised of aluminum, molten aluminum from the collapsed liner also enters the perforation tunnel. After detonation, the pressure increase induces the flow of water from the well into the tunnel, creating a local, secondary explosive reaction between aluminum and water. As shown in FIG. 5*b*, following the secondary explosion, the crushed zone 26 is substantially eliminated and a fracture 30 is formed at the end (or tip) of the tunnel. The elimination of the crushed zone 26 provides for an increase in, or widening of, the cross-sectional diameter of the perforation tunnel, by at least a quarter inch around the tunnel, and elimination of the barrier to inflow or outflow of fluids caused by skin effects. Moreover, the highly exothermic reaction allows for the cleaning out of the tunnels even without the underbalance customarily employed. As shown in FIG. 6, the effective wellbore radius, $r_e$*, as compared in dashed lines to the prior art method obtaining an effective wellbore radius, $r_e$ (and plugged at the tip 18 with debris), is extended by the removal of the compacted fill, having a clean tunnel depth equal to the total depth of penetration of the jet. Further, when a fracture 30 is created at the tip of the tunnel, an even greater effective wellbore radius is obtained, $r_e$**.

Since every shaped charge independently conveys a discrete quantity of reactive material into its tunnel, the cleanup of any particular tunnel is not affected by the others. The effectiveness of cleanup is thus independent of the prevailing rock lithology and independent of the permeability at the point of penetration. Consequently, a very high perforation efficiency is achieved, theoretically approaching 100% of the total holes perforated, within which the clean tunnel depth will be equal to the total depth of penetration (since compacted fill is removed from the tunnel tip), as depicted in FIG. 6. Tunnels perforated are highly conducive to both production and injection purposes.

Debris-free tunnels created by the present invention result in: an increased rate of injection or production under a given pressure condition; a reduced injection pressure at a given injection rate; a reduced injection or production rate per open perforation resulting in less perforation friction and less erosion; an improved distribution of injected or produced fluids across the perforated interval; a reduced propensity for catastrophic loss of injectivity or productivity due to solids bridging (screen out) during long periods of production or slurry disposal or during proppant-bearing stages of an hydraulic fracture stimulation; the minimization of near-wellbore pressure losses; and an improved predictability of the inflow or outflow area created by a given number of shaped charges (of specific value to limited entry perforation for outflow distribution control). Further, fracture initiation pressures can be significantly lowered; in some cases to the point where a formation that could not previously be fractured using conventional wellsite equipment can now be fractured satisfactorily.

The following examples are meant only to illustrate, but in no way to limit, the claimed invention.

Example 1

Figure 7:
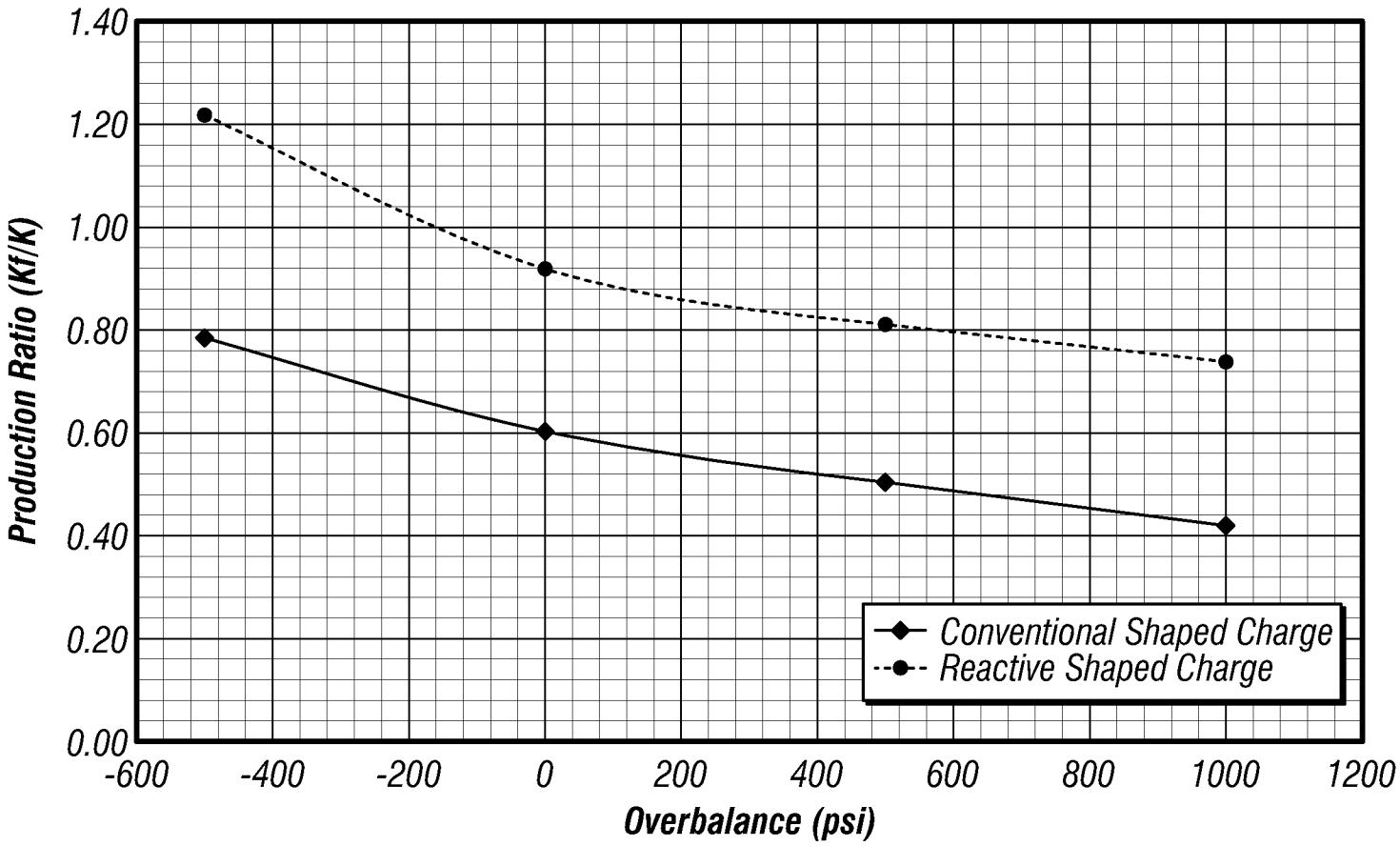
FIG. 7 is a graphical representation of the comparative production rates for conventional and reactive shaped charges at varying balancing pressures.

Laboratory studies comparing the productivity of perforations shot at balanced and near-balanced conditions with conventional methods have shown that the present method consistently delivers 20-40% greater productivity (under single shot laboratory conditions), as shown by tests conducted following American Petroleum Institute Recommended Practice 19-B (API RP 19-B), Section 4. The results of one such program of tests are presented below with regard to FIG. 7, which depicts the comparative production rates for conventional and reactive shaped charges at varying balancing pressures in Berea sandstone at an effective stress of 4,000 psi. As used herein, the productivity ratio (kf/k) is the permeability measured when flowing through unperforated rock. The effective stress within a rock is equal to the total stress (σ) minus the pore pressure ($p_p$). Total stress (σ) can be visualized as the weight of a water-saturated column of rock. Two components of that weight are the rock with empty pores and the weight of the water that fills the pores. Effective stress is defined as the calculated stress that is brought about by its self weight and the pressure of fluids in its pores. It represents the average stress carried by the rock fabric according to:

$$\bar{\Sigma}=\sigma-P_p$$

Effective stresses changes cause consolidation of the rock in areas where fluid pressure has reduced (i.e., its particles move more closely together). Effective stress increases and reaches a maximum at complete consolidation when the rock becomes grain supported and before shear failure occurs. During fluid withdrawal from an oil or gas reservoir, the pressure within the rock will decline so upsetting the balance of forces and transferring more of the overburden weight to the grain structure. As the effective stress increases, the compressive strength of the rock also increases, making it a harder target for a shaped charge to penetrate. Further, the increased effective stress inhibits removal of debris from the tunnel as a result of reduced formation permeability due to compaction and greater debris integrity. As the reservoir pressure declines under depletion, the effective stress on the reservoir increases correspondingly. This reduces the penetration that can be achieved with a shaped charge perforating system, and increases the difficulty to effectively clean up the resulting tunnels. However, even under an effective stress of 4,000 psi, the reactive shaped charges produce a higher production rate at near balancing conditions.

Example 2

Table 1, depicts data generated using a 15-gram version of a reactive shaped charge into Berea sandstone. In addition to the improved productivity at near balanced conditions, the productivity improvement versus a conventional shaped charge is apparent under conditions ranging from 500 psi underbalance to 1000 psi overbalance.

TABLE 1

| Test # | Charge | Balance (psi) | Pen. (in) | Permeability prior to perforation (mD) | Permeability measured after perforation (mD) | Productivity Ratio — | Flow Imp. — |
|---|---|---|---|---|---|---|---|
| 1 | Conventional | 1000 | 9.20 | 142 | 60 | 0.42 | |
| 2 | Reactive | 1000 | 8.20 | 143 | 106 | 0.74 | 76% |
| 3 | Conventional | 500 | 6.20 | 106 | 53 | 0.50 | |
| 4 | Reactive | 500 | 8.60 | 106 | 86 | 0.81 | 61% |

TABLE 1-continued

| Test # | Charge | Balance (psi) | Pen. (in) | Permeability prior to perforation (mD) | Permeability measured after perforation (mD) | Productivity Ratio — | Flow Imp. — |
|---|---|---|---|---|---|---|---|
| 5 | Conventional | 0 | 8.85 | 130 | 79 | 0.60 | |
| 6 | Reactive | 0 | 9.05 | 111 | 102 | 0.92 | 52% |
| 7 | Conventional | −500 | 9.05 | 113 | 88 | 0.79 | |
| 8 | Reactive | −500 | 9.10 | 140 | 170 | 1.22 | 55% |

As seen by the above results, even in situations where no underbalance is used, or without the application of a pressure differential, the flow is improved by as much as 52%, where the productivity ratio for reactive shaped charges is as high as 0.92 in contrast with the productivity for conventional shaped charges at 0.60. Moreover, under the tested circumstances of 500 psi underbalance and at overbalance pressures of 500 and 1,000 psi, an improvement in flow improvement and productivity is also achieved using the method of the present invention.

Example 3

The field application of reactive perforators in wellbores where limited or no underbalance has been applied has shown that productivity is significantly improved over offset wells perforated in a conventional manner and/or compared to previous perforations in the same well using conventional equipment and methods. The results of five experimental programs conducted using a variety of sandstone targets under different conditions are summarized in Table 2. Some studies involved only API RP-19B Section 2 type testing, which evaluates perforation geometry in a stressed rock target but does not measure the flow performance of the resulting perforation.

TABLE 2

Examples of Performance Comparison Test Programs between Reactive Charges and Best-in-Class Conventional Deep Penetrating Charges

| Charge Tested | UCS (psi) | Effective Stress (psi) | Average Porosity (%) | Under-balance (psi) | Clear Tunnel Depth Improvement with Reactive Perforator | Lab Productivity Improvement with Reactive Perforator |
|---|---|---|---|---|---|---|
| 23 g Reactive | 11,000 | 4,000 | 11.7 | 1,500 | 216% | N/A |
| 39 g Reactive | 11,000 | 5,000 | 10.6 | 0 | 82% | N/A |
| 25 g Reactive | 5,500 | 3,000 | 21.6 | 0 | 235% | 25% |
| 25 g Reactive | 7,000 | 4,000 | 19.0 | 500 | 80% | 28% |
| 6 g Reactive | 10,000 | 4,000 | 12.0 | 0 | 35% | N/A |

As can be seen from the table, reactive perforators offer significant perforation geometry and productivity ratio improvement across a wide range of conditions. In total, more than one thousand stressed rock test shots have been conducted using reactive shaped charges used in the present invention. Benefits have been observed not only in simple cased, cemented and perforated wells that will produce without further activity but also on wells that have already been perforated with a conventional system of shaped charges and in poorly consolidated formations, whereby the formation will fail under drawdown resulting in the flow of formation solids into the well during production (i.e., the recovery of hydrocarbons from a subterranean formation) Success has been observed in wells with an average permeability <0.001 mD to >200 mD. Re-perforation (perforation in wells previously perforated with a conventional system) with a reactive perforating system has even resulted in the restoration or enhancement of productivity compared to the initial performance of the well when newly drilled.

Reactive perforators are equally affected from a total penetration point of view, but will continue to deliver a much greater percentage of clean tunnels. This results in a significant improvement in clear tunnel depth and therefore in production performance. In some cases, reperforation with reactive perforating systems has resulted in a more than ten-fold productivity increase. In one case, re-perforation of a gas well that had historically never produced more than 0.5 MMscf/d despite several remedial interventions, led to a flow rate in excess of 4 MMscf/d and has followed a normal decline curve during its early production life.

Even though the figures described above have depicted all of the explosive charges as having uniform size, it is understood by those skilled in the art that, depending on the specific application, it may be desirable to have different sized explosive charges in the perforating gun. It is also understood by those skilled in the art that several variations can be made in the foregoing without departing from the scope of the invention. For example, the particular location of the explosive charges can be varied within the scope of the invention. Also, the particular techniques that can be used to fire the explosive charges within the scope of the invention are conventional in the industry and understood by those skilled in the art.

It will now be evident to those skilled in the art that there has been described herein an improved perforating gun that reduces the amount of debris left in the perforations in the hydrocarbon bearing formation after the perforating gun is fired without the need for the underbalance induced surge flow typically used to clear debris from perforation tunnels. Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A method for perforating a wellbore comprising the steps of:

a) loading at least one charge comprising a reactive shaped charge within a charge carrier;

b) positioning the charge carrier down the wellbore adjacent to an underground hydrocarbon bearing formation, the wellbore being in a pressure condition;

c) without changing the pressure condition of the wellbore to a more underbalanced condition after the step of positioning, detonating the at least one charge in the wellbore to create a first and second explosive event, wherein the first explosive event creates at least one perforation tunnel within the adjacent formation, said perforation tunnel being surrounded by a crushed zone, and wherein the second explosive event is created by an exothermic intermetallic reaction between shaped charge liner components, the second explosive event eliminating a substantial portion of said crushed zone and clearing debris from within said perforation tunnel.

2. The method of claim 1, wherein said second explosive event produces at least one fracture at the tip of said perforation tunnel.

3. The method of claim 1, wherein said underground hydrocarbon bearing formation of positioning step b) is a formation that has already been perforated by a conventional shaped charge and the step of positioning comprises positioning the charge carrier in the wellbore adjacent to existing perforations to re-perforate an existing perforation with a shaped charge.

4. The method of claim 3, wherein step c) further results in the creation of a clear tunnel depth substantially equal to the total depth of penetration.

5. The method of claim 1, wherein said reactive shaped charge is comprised of a liner having at least one metallic element capable of producing an exothermic reaction.

6. The method of claim 1, wherein said first and second explosive events take place within microseconds.

7. The method of claim 1, wherein the formation of step b) is shallow or depleted, and contains fluid wherein a hydrostatic pressure of the fluid is such that the wellbore is in an underbalance condition.

8. The method of claim 1, wherein the liner comprises any of aluminum, cerium, molybdenum, nickel, niobium, lead, palladium, tantalum, zinc and zirconium.

9. A method for re-perforating a wellbore in balanced or over-balanced condition, said method comprising the steps of:

a) loading at least one reactive shaped charge within a charge carrier;

b) positioning the charge carrier down a wellbore adjacent to an underground hydrocarbon bearing formation, the formation having been previously perforated by a non-reactive shaped charge to form a tunnel therein, the tunnel surrounded by a crushed zone;

c) without changing the balance or overbalance condition of the wellbore to an underbalanced condition after the step of positioning, detonating the reactive shaped charge in the wellbore to create a first and a second explosive event;

wherein the first explosive event projects a shape charged jet into the tunnel within the adjacent formation; and wherein the second explosive event is created by an exothermic intermetallic reaction between shaped charge liner components, the second explosive event eliminating a substantial portion of the crushed zone, expelling debris from within said tunnel, and creating a clear tunnel depth substantially equal to the total depth of the tunnel.

10. The method of claim 9, wherein the formation comprises water, and molten metal from the intermetallic reaction interacts with the water.

11. The method of claim 9, wherein the liner comprises any of aluminum, cerium, molybdenum, nickel, niobium, lead, palladium, tantalum, zinc and zirconium.

* * * * *